US006111487A

United States Patent [19]

Hoffmann et al.

[11] Patent Number: 6,111,487

[45] Date of Patent: Aug. 29, 2000

[54] ELECTROMAGNETIC RELAY WITH A NARROW CONSTRUCTION AND A METHOD OF MANUFACTURE THEREOF

[75] Inventors: Ralf Hoffmann; Angelo Polese, both of Berlin, Germany

[73] Assignee: Tyco Electronics Logistics AG, Steinach/SG, Switzerland

[21] Appl. No.: 09/101,056

[22] PCT Filed: Jan. 9, 1997

[86] PCT No.: PCT/DE97/00030

§ 371 Date: Jun. 29, 1998

§ 102(e) Date: Jun. 29, 1998

[87] PCT Pub. No.: WO97/27604

PCT Pub. Date: Jul. 31, 1997

[30] Foreign Application Priority Data

Jan. 25, 1996 [DE] Germany ..... 196 02 643

[51] Int. Cl.[7] ..... H01H 51/22; H01H 67/02; H01H 9/02; H01H 11/00

[52] U.S. Cl. ..... 335/78; 335/83; 335/128; 335/202; 29/622; 29/756

[58] Field of Search ..... 335/78–86, 128, 335/124, 202; 29/622, 756

[56] References Cited

U.S. PATENT DOCUMENTS

| | | | |
|---|---|---|---|
| 4,542,582 | 9/1985 | Tsunakawa | 29/622 |
| 4,758,809 | 7/1988 | Bell | 335/128 |
| 5,289,144 | 2/1994 | Liao | 335/78 |
| 5,497,132 | 3/1996 | Mader | 335/78 |

FOREIGN PATENT DOCUMENTS

| | | |
|---|---|---|
| 38 29 035 C2 | 8/1988 | Germany . |
| 38 35 105 C2 | 10/1988 | Germany . |
| 3414731A1 | 4/1994 | Germany . |
| 295 07 780 U 1 | 5/1995 | Germany . |

*Primary Examiner*—Michael L. Gellner
*Assistant Examiner*—Raymond Barrera
*Attorney, Agent, or Firm*—Hill & Simpson

[57] ABSTRACT

The relay has, one after the other on an elongate, narrow base body, a magnetic system and a contact arrangement having at least one fixed contact carrier and at least one movable contact spring. The contact carriers are in this case each embedded by a middle section into the plastic of a base body in such a way that their connecting lugs lie in a plane parallel to the longitudinal axis of the relay, while their contact-making end sections, which emerge on the upper side of the base body, lie in planes which are parallel to one another and perpendicular to the plane of the connecting lugs. This enables dimensionally accurate embedding of the contact carriers with good insulation with respect to the magnetic system and with easy processing from a sheet-metal plate.

21 Claims, 2 Drawing Sheets

ELECTROMAGNETIC RELAY WITH A NARROW CONSTRUCTION AND A METHOD OF MANUFACTURE THEREOF

BACKGROUND OF THE INVENTION

Field of the Invention

The present invention relates generally to electromagnetic relays and, more specifically, electromagnetic relays having a narrow, elongated base body with fixed contact carriers embedded in the base body that are cut from a common plate of sheet metal. The present invention also relates to a method of manufacturing such a relay.

Relays having a narrow structure of this type are disclosed for example in DE 38 29 035 C2 and DE 38 35 105 C2. The anchoring of the contact carriers in a single row and the position of the connecting lugs in a single sheet-metal plane result in advantageous production because the partially cut-free contact carrier elements which are still connected to the plate enable easy handling in the production run and accurate positioning in the base body. In the case of the known relay structure, the contact-making sections of the contact carriers are arranged together with an armature underneath a coil winding with a toroidal iron core, the actuation direction being effected transversely with respect to the longitudinal axis of the relay structure. Insulation between the magnetic system and load circuit is problematic, however, due to the interlacing of armature and contact springs. High currents cannot be switched by this system on account of the excessively small insulating clearances. In addition, a changeover contact can be realized only with difficulty in the case of this structure; at least such a changeover contact would manifest itself at the expense of the narrow structure, given said actuation direction.

DE 34 14 731 A1 has also already disclosed a basic structure of a relay in which a magnetic system and a contact arrangement are arranged one after the other in the longitudinal direction of the relay, the contact arrangement being actuated by means of a slide which can be moved parallel to the longitudinal axis of the relay. However, a narrow structure is not intended in that case, since two sets of contacts are arranged next to one another transversely with respect to the longitudinal axis of the relay. Although the contact carriers are embedded in the base body of the relay, the flat connecting lugs each lie in planes transversely with respect to the longitudinal axis of the relay, with the result that processing-from a plate is in that case neither striven for nor would it actually be implementable.

SUMMARY OF THE INVENTION

An object of the present invention is to provide a JIG, narrow electromagnetic relay of the type mentioned in the introduction and to specify a method for its production which, given any desired contact complement as make contact, break contact and, in particular, as changeover contact, always enables the same narrow structure, at the same time permits large insulating clearances with respect to the magnetic system and enables particularly simple production by arrangement of the connecting lugs in a single sheet-metal plane; in this case, the intention is to enable the connecting lugs to be embedded in the base body whilst hanging at least partially from a plate.

In the case of a relay of the abovementioned type, this aim is achieved according to the invention by virtue of the fact that all of the contact elements are each angled by their middle section in the region of anchoring in the base body, in such a way that their contact-making end sections, from their point of emergence from the base body onwards, are located in a single row, but in planes which are parallel to one another and perpendicular to the base plane and to the plane of the connecting lugs, and that each contact spring is actuated in the direction of the longitudinal axis of the relay.

In the case of the relay according to the invention, then, the contact-making sections of the contact carriers are located transversely with respect to the longitudinal axis of the relay, thereby enabling actuation in the direction of this longitudinal axis. Since the contact carriers are always arranged only in one row, a narrow structure of the relay is always ensured since the width is determined by the dimension of the magnetic system and even a changeover contact does not increase the width. It would even be possible for two sets of contacts to be arranged one after the other in the longitudinal direction of the relay and be actuated by a longitudinal slide. In contrast to the known relays with such an arrangement of the contact carriers and such an actuation direction, however, in this case the connecting lugs of the contact carriers do not extend parallel to the contact-making sections thereof; rather the common plane of the connecting lugs is located perpendicular to the planes of the contact-making sections. In this way, not only is the requirement for a connection configuration in one plane (inline configuration) taken into account, but also the processing of the contact carriers from a plate in the production run is made possible. The transition from the connection plane of the contact carriers to the respective planes of the contact-making end sections is made in the anchoring region within the base body. The parts projecting from the base body are thus aligned in their respective plane and are no longer bent; as a result, due to the anchoring in the base body, they can be brought with high accuracy into their end position and be fixed in this end position.

The contact carriers are expediently angled in their middle section, which is anchored in the base body, in each case at least about two bending axes which are perpendicular to one another, as a result of which the transition from the plane of the connecting lugs to the respective contact plane is effected, yet at the same time it becomes possible to obtain the contact carriers from the plate in a manner that saves a great deal of material. As a result of the angling in the region of the base body, it is possible for the connecting lugs to have a desired, large insulation clearance with respect to one another, while their contact-making end sections acquire the short contact separation that is necessary.

In an advantageous embodiment, it is provided that, for a changeover contact, two fixed contact carriers are embedded in the material of the base body, while a spring carrier lying between them is inserted by a contact spring, fastened to said spring carrier, into a laterally open slot in the base body. However, it would also be possible partially to cut free the spring carrier together with the fixed contact carriers from the common plate, then to provide it with the contact spring and, whilst still connected to the common plate, to embed it with the fixed contact carriers jointly into the material of the base body. In addition, it would alternatively be conceivable to obtain both the contact spring and the fixed contact carriers from the same material of a common plate and embed them jointly in the base body.

The inventive configuration of the contact arrangement can be realized in a particularly advantageous manner in the case of a relay in which the base body has a partition between the magnetic system and the contact arrangement as well as an insulating wall on a long side of the base body, which insulating wall is perpendicular with respect to the bottom side; in this case, particularly favorable insulation between the contact carriers and the magnetic system is produced when the plane of the connecting lugs runs on one side in the region underneath the longitudinal insulating wall.

In a method for the production of the relay according to the invention, first of all a base body is molded from plastic and provided with the contact carriers, an electromagnetic system then being mounted on this base body; in this context, according to the invention, at least one contact carrier having a connecting lug, a middle section and a contact-making end section is cut free from a sheet-metal plate in such a way that it still hangs from the plate by its respective connecting lug; afterwards, the middle section of each contact carrier is bent out of the plane of the plate in such a way that the contact-making end section is located in its own plane which is perpendicular to the base plane and to the plane of the plate; and the base body is then molded by embedding the respective middle sections in plastic, after which finally the connecting lugs are separated from the sheet-metal plate.

Depending on the desired structure of the contact arrangement, it is possible to obtain only the fixed contact carrier or carriers from the plate and embed it or them into the base body, while a spring carrier with the contact spring fastened thereto is subsequently inserted into a slot in the base body, or else to cut free the spring carrier together with the fixed contact carriers and jointly embed them. Other objects and advantages of the present invention will become apparent from reading the following detailed description and appended claims, and upon reference to the accompanying drawings.

BRIEF DESCRIPTION OF THE DRAWINGS

The invention is explained in more detail below using an exemplary embodiment with reference to the drawing.

In the drawing.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
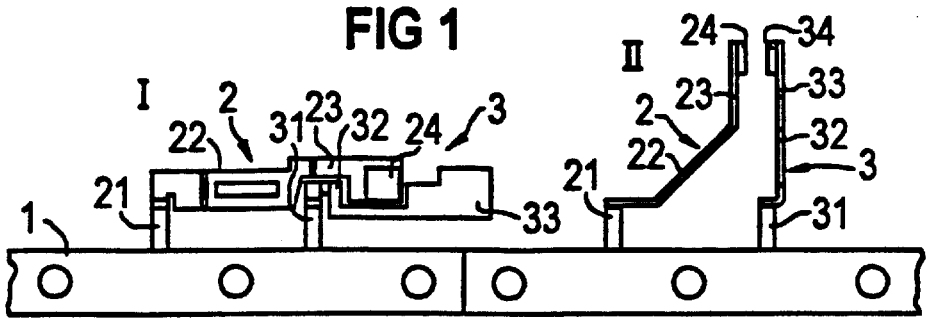
FIG. 1 illustrates two successive sections of a sheet-metal plate in the production run with a pair of fixed contact carriers in two successive processing stages.
Figure 2:
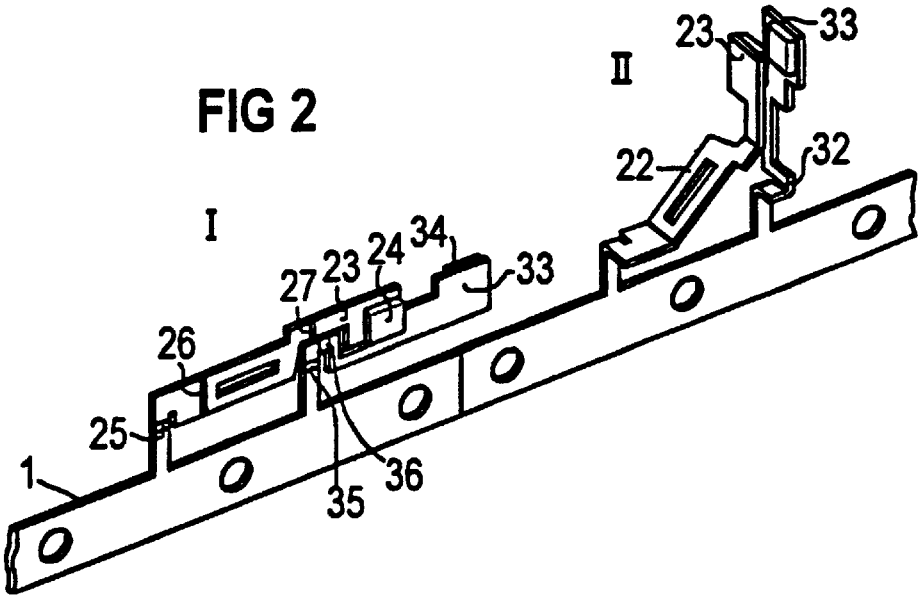
FIG. 2 illustrates the sheet-metal plate section of FIG. 1 in a perspective view.

FIGS. 1 to 4 show the different method steps for obtaining a relay base body with contact arrangement by partly encapsulating a sheet-metal plate by injection molding. In this case, two fixed contact carriers 2 and 3 are obtained from a plate 1 and processed successively in the production cycle. Thus, FIGS. 1 and 2 show these fixed contact carriers in a first method stage I and in a second method stage II.

In the first method stage I, the fixed contact carriers 2 and 3 are each cut free from the plate. They each have a connecting lug 21 and 31, respectively, a middle section 22 and 32, respectively, for embedding in the yet to be described base body, and a contact-making end section 23 and 33, respectively, which is already provided with a fixed contact 24 and 34, respectively, in this stage. The method stage II is reached by bending the middle section 22 and 32 about mutually perpendicular bending lines 25, 26 and 27 and, respectively, 35 and 36, in which method stage II the two contact-making end sections 23 and 33 are located opposite one another with their fixed contacts 24 and 34 parallel.

Figure 3:
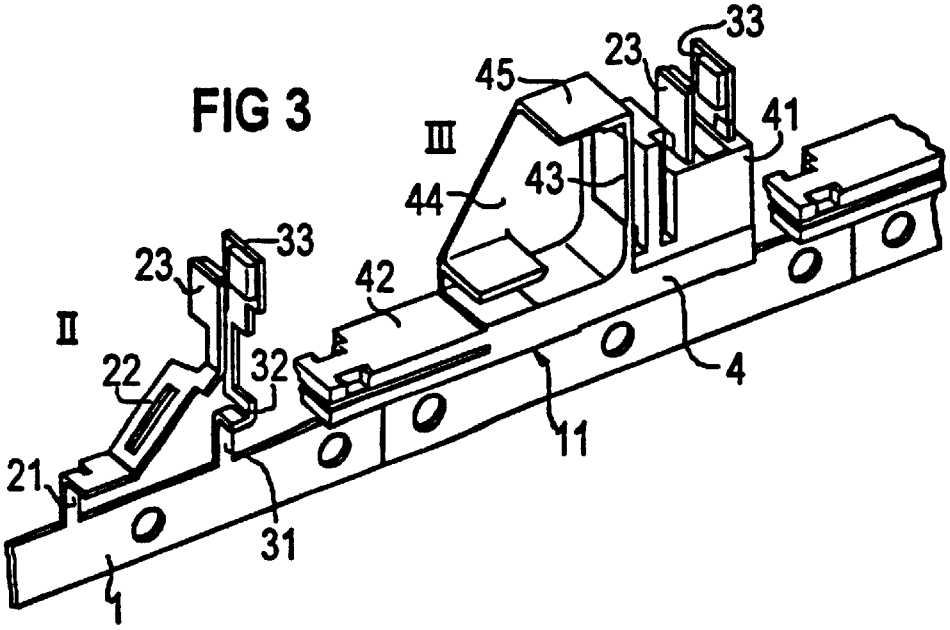
FIG. 3 illustrates the sheet-metal plate section of FIG. 2 in a further production stage.

FIG. 3 shows a further method sequence. This firstly shows the stage II as in FIG. 2 once again, said stage being followed by the stage III. In this stage, a plastic base body 4 of the relay is formed by encapsulating the middle sections 22 and 32 by injection molding, which base body, on the one hand, is connected to the plate 1 via the connecting lugs 21 and 31 (visible in FIG. 4), while, on the other hand, the end sections 23 and 33 of the fixed contact carriers protrude from the plastic of the base body. The angular portions of the fixed contact carriers are thus completely embedded in the plastic. All that are visible are the connecting lugs 21 and 31 lying in the plane of the plate 1, on the one hand, and the contact-making end sections 23 and 33 lying in planes which are perpendicular thereto. As a result, the fixed contacts can be positioned very exactly with regard to the base body. Subsequent deforming of the contact carriers is not necessary. In addition, this extensive embedding results in large insulating clearances with respect to the magnetic system of the relay which, in accordance with FIG. 5, is arranged on that end of the base body which is opposite to the fixed contact carriers. In the region where the fixed contact carriers 2 and 3 are encapsulated by injection molding, the base body 4 forms a contact block 41, which, with ribs and grooves, forms large insulating clearances with respect to the magnetic system. In order to accommodate the magnetic system, the base body 4 forms a baseplate 42, the underside of which defines a base plane 11. As insulation between the magnetic system and the contact arrangement, the base body has, located perpendicularly to the baseplate, an insulating wall 43 as well as a longitudinal wall 44 on a long side, which longitudinal wall forms, together with a top wall 45, a half-shell for accommodating one end of the yet to be described magnetic system.

Figure 4:
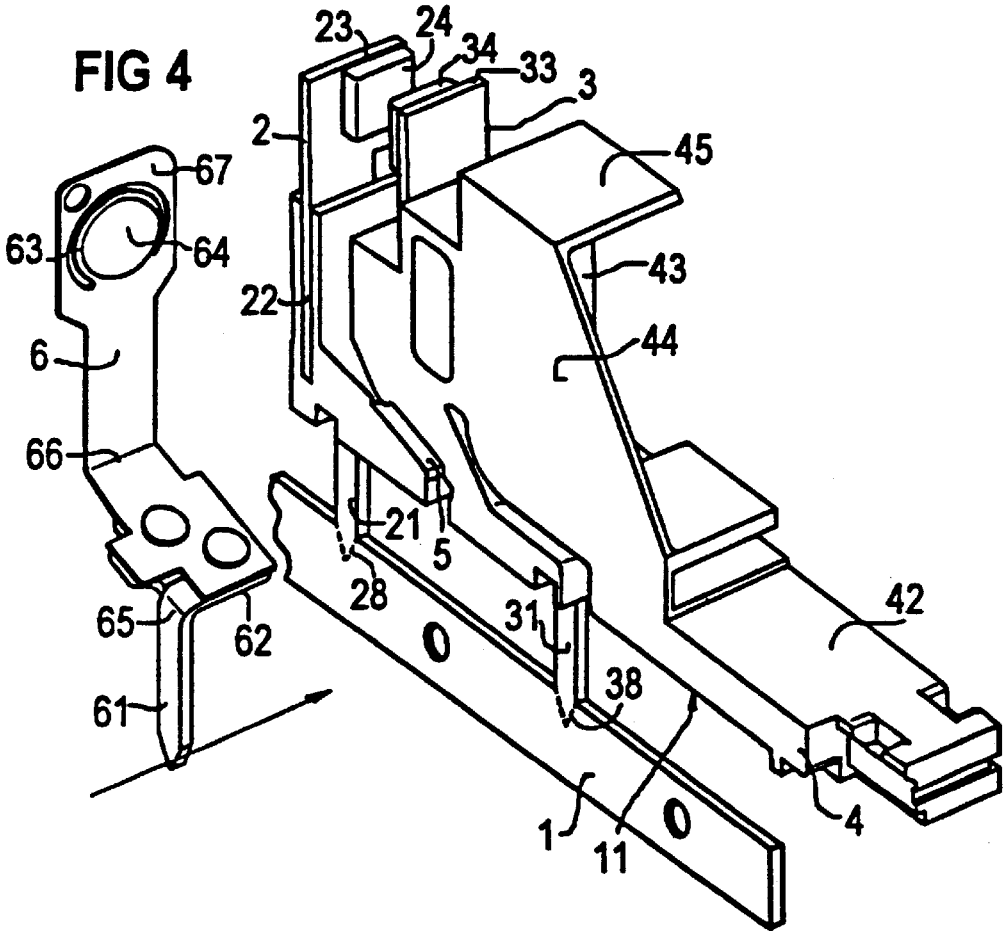
FIG. 4 illustrates a relay base body, obtained by encapsulating a sheet-metal plate section by injection molding, with a contact spring that can additionally be inserted.
Figure 5:
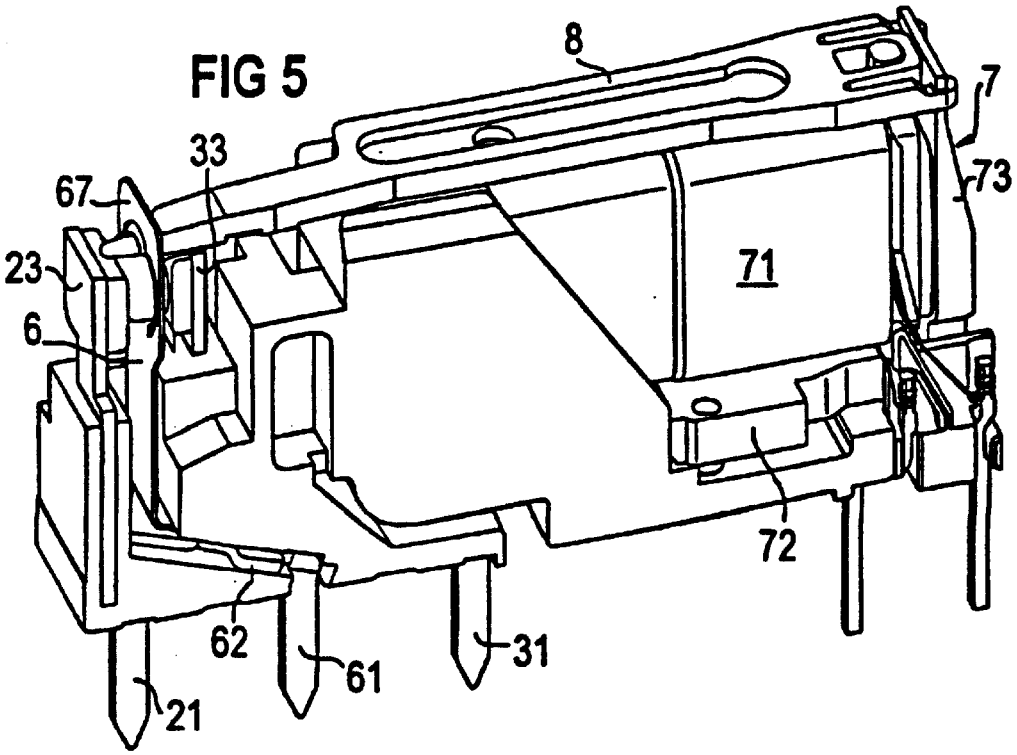
FIG. 5 illustrates a finished relay system mounted on the base body of FIG. 4 (without a housing cap).

As can be seen in FIG. 4, with a view of the base body from an opposite side, an accommodating slot 5 for securing an inserted contact spring 6 is provided in this case between the two fixed contact carriers 2 and 3. The contact spring itself is fixed on a spring carrier 62 with a connecting lug 61, for example by spot welding. The spring carrier 62 is angled about a bending axis 65 with respect to its connecting lug 61; in addition, the contact spring 6 is angled upward about a bending axis 66 which is perpendicular thereto. Consequently, in the case of the contact spring arrangement, too, the spring section 63 carrying a contact 64 lies in a plane perpendicular to the plane of the connecting lug 61. After the connecting lugs 21 and 31 have been separated at the dashed lines 28 and 38 and after the contact spring arrangement 6 has been inserted into the slot 5, the connecting lug 61 lies in a plane with the connecting lugs 21 and 31, while the contact-making section 63 of the contact spring 6 lies parallel between the two contact-making end sections 23 and 33 of the fixed contact carriers.

As has already been mentioned beforehand, it would also be possible to cut free the spring carrier 62 with the fixed contact carriers 2 and 3 from the plate 1, in which case the resolution of the individual sections would have to be effected in a somewhat different manner from that according to FIG. 1. The contact spring 6 could then be fitted to the cut-free spring carrier 62 and be encapsulated by injection molding together with the latter and the fixed contact carriers during the formation of the base body. If it is possible to use one and the same spring sheet-metal material both for the contact spring and for the fixed contact carriers, all these parts could be jointly cut free and encapsulated by injection molding.

FIG. 5 shows the finished mounted relay. Here, in the base body according to FIG. 4, after the contact spring 6 has been inserted, a magnetic system 7 having a coil 71, a core-yoke arrangement 72 and an armature 73 is placed onto the baseplate 42 and pushed from a long side into the half-shell formed by the walls 43, 44 and 45. Since the wall 44 covers the magnetic system toward one side in the direction of the contact system, the connecting lugs 21, 31 and 61 essentially lie below this longitudinal wall 44. In this way, the creepage paths from the connecting lugs to the open side of the half-shell and thus to the magnetic system are additionally lengthened.

A slide 8 transmits the switching movement of the armature 73 to the end section 67 of the contact spring 6, as a result of which the semicircularly cut-free contact-making section 63 of the spring is actuated.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An electromagnetic relay comprising:

a narrow elongated base body fabricated from an insulating material and comprising an underside and an upper side, the underside defining a base plane, the upper side accommodating an electromagnetic system and a contact arrangement, the base body further comprising a longitudinal axis, the contact arrangement comprising at least one fixed contact carrier and at least one movable contact spring, the fixed contact carrier comprising a middle section disposed between a flat connecting lug and a contact-making end section, the movable contact spring also comprising a middle section disposed between a flat connecting lug and a contact-making end section, the flat connecting lugs of the fixed contact carrier and movable contact spring each having a width and a thickness, the width of each flat connecting lug being disposed in a common plane parallel to the longitudinal axis of the base body and perpendicular to the base plane, the middle section of the fixed contact carrier being embedded in the material of the base body and anchoring the fixed contact carrier to the base body, the contact-making end sections of the fixed contact carrier and the movable contact spring being disposed in alignment with one another and perpendicular to the base plane and to the common plane of the connecting lugs, the contact-making end section of the contact spring being actuated in a direction parallel to the longitudinal axis of the base body.

2. The relay of claim 1, wherein the middle section of the movable contact spring engages the base body and anchors the movable contact spring to the base body.

3. The relay of claim 1 wherein the connecting lug of the movable contact spring engages the base body and anchors the movable contact spring to the base body.

4. The relay of claim 1, wherein each fixed contact carrier further comprises a first bend positioned along a first bending axis disposed between the connecting lug and the middle section and a second bend positioned along a second bending axis disposed between the contact-making end section and the middle section, the first and second bending axes being perpendicular to one another.

5. The relay of claim 1 wherein the at least one fixed contact carrier comprises two fixed contact carriers, both of which are embedded in the material of the base body, and the movable contact spring is connected to a spring carrier disposed between the fixed contact carriers, and the base body comprises a lateral slot, the spring carrier being accommodated in the lateral slot of the base body.

6. The relay of claim 1 wherein the base body comprises a partition disposed between the magnetic system and the contact arrangement.

7. An electromagnetic relay comprising:

a narrow elongated base body fabricated from an insulating material and comprising an underside and an upper side, the underside defining a base plane, the upper side accommodating an electromagnetic system and a contact arrangement, the base body further comprising a longitudinal axis, the contact arrangement comprising at least one fixed contact carrier and at least one movable contact spring, the fixed contact carrier comprising a middle section disposed between a connecting lug and a contact-making end section, the movable contact spring also comprising a middle section disposed between a connecting lug and a contact-making end section, the connecting lugs of the fixed contact carrier and movable contact spring being disposed in a common plane parallel to the longitudinal axis of the base body and perpendicular to the base plane, the middle section of the fixed contact carrier being embedded in the material of the base body and anchoring the fixed contact carrier to the base body, the contact-making end sections of the fixed contact carrier and the movable contact spring being disposed in alignment with one another and perpendicular to the base plane and to the common plane of the connecting lugs, the contact-making end section of the contact spring being actuated in a direction parallel to the longitudinal axis of the base body, wherein the base body comprises a partition disposed between the magnetic system and the contact arrangement, and wherein the base body further comprises an insulating wall extending longitudinally along one side of the base body, the insulating wall being disposed perpendicular to the base plane, the insulating wall being coplanar with the connecting lugs and disposed above the connecting lugs.

8. An electromagnetic relay comprising:

a narrow, elongate base body fabricated from an insulating material and comprising an underside and an upper side, the underside defining a base plane, the upper side accommodating an electromagnetic system and a contact arrangement, the base body further comprising a longitudinal axis, the contact arrangement comprising at least two fixed contact carriers and at least one movable contact spring, the fixed contact carriers each comprising a middle section disposed between a flat connecting lug and a contact-making end section, the movable contact spring also comprising a middle section disposed between a flat connecting lug and a contact-making end section, the contact-making end section of the movable contact spring being disposed between the contact-making end section of the fixed contact carriers, the flat connecting lugs of the fixed contact carriers and movable contact spring each having a width and a thickness the width of each flat connecting lug being disposed in a common plane parallel to the longitudinal axis of the base body and perpendicular to the base plane, the middle sections of the fixed contact carriers being embedded in the material of the base body and anchoring the fixed contact carriers to the base body, the contact-making end sections of the fixed contact carriers and the movable contact spring being disposed in alignment with one another and perpendicular to the base plane and to the common plane of the connecting lugs, the contact-making end section of the contact spring being actuated between the contact-making end sections of the fixed contact carriers and in a direction parallel to the longitudinal axis of the base body.

9. The relay of claim 8, wherein the middle section of the movable contact spring engages the base body and anchors the movable contact spring to the base body.

10. The relay of claim 8 wherein the flat connecting lug of the movable contact spring engages the base body and anchors the movable contact spring to the base body.

11. The relay of claim 8, wherein each fixed contact carrier further comprises a first bend positioned along a first bending axis disposed between the connecting lug and the middle section and a second bend positioned along a second bending axis disposed between the contact-making end section and the middle section, the first and second bending axes being perpendicular to one another.

12. The relay of claim 8, wherein the movable contact spring is connected to a spring carrier disposed between the fixed contact carriers, and the base body comprises a lateral slot, the spring carrier being accommodated in the laterally slot of the base body.

13. The relay of claim 7, wherein the base body comprises a partition disposed between the magnetic system and the contact arrangement.

14. The relay of claim 13, wherein the base body further comprises an insulating wall extending longitudinally along one side of the base body, the insulating wall being disposed perpendicular to the base plane, the insulating wall being coplanar with the connecting lugs and disposed above the connecting lugs.

15. A method of manufacturing a relay comprising the following steps:

cutting at least one fixed contact carrier comprising a connecting lug and a contact-making end section with a middle section disposed there between from a sheet-metal plate disposed in a plane while maintaining a connection between the connecting lug and an elongated remaining portion of the plate, the middle section being bent out of the plane of the plate in such a way that the contact-making end section is disposed perpendicular to the plane of the plate, molding a base body from insulating material and embedding the middle section of the contact carrier in the insulating material with the remaining portion of the plate extending along a longitudinal axis of the base body and below a base plane of the base body, the base body being narrow and elongated comprising an underside and an upper side, the underside defining the base plane, the remaining portion of the plate and the terminal lug extending perpendicularly downward from the base plane, separating the connecting lugs from the remaining portion of the plate and mounting an electromagnetic system on the upper side of the base body.

16. The method of claim 15, wherein the step of connecting a contact spring further comprises embedding the middle section of the contact spring in the base body.

17. The method of claim 15, wherein the contact spring is also cut from the sheet metal plate.

18. The method of claim 15, wherein each fixed contact carrier further comprises a first bend positioned along a first bending axis disposed between the connecting lug and the middle section and a second bend positioned along a second bending axis disposed between the contact-making end section and the middle section, the first and section bending axes being perpendicular to one another.

19. The method of claim 15, wherein the at least one fixed contact carrier comprises two fixed contact carriers, both of which are cut from the sheet-metal plate in a spaced apart fashion and both of which are embedded in the base body in a spaced apart fashion, the method further comprising the step of connecting a contact spring to the base body between the two fixed contact carriers, the contact spring also comprising a connecting lug and a contact-making end section with a middle section disposed there between, the connecting lug of the contact spring being coplanar with the connecting lugs of the fixed contact carriers and the contact-making end section of the contact spring being parallel to the contact-making end sections of the fixed contact carriers.

20. The method of claim 19, wherein the contact spring comprises a spring carrier cut from a sheet metal plate which forms said connecting lug and said middle section of the contact spring, the contact-making spring end section being connected to the spring carrier, the step of connecting the contact spring to the base comprising inserting the spring carrier into a slot in the base body.

21. The method of claim 19, wherein the contact spring comprises a spring carrier cut from a sheet metal plate which forms said connecting lug and said middle section of the contact spring, the contact-making spring end section being connected to the spring carrier, the step of connecting the contact spring to the base comprising embedding the spring carrier in the base body.

* * * * *